United States Patent [19]

Cooper

[11] 4,324,065

[45] Apr. 13, 1982

[54] BALANCE OPERATED GAME

[75] Inventor: Julius Cooper, New Hyde Park, N.Y.

[73] Assignee: Ideal Toy Corporation, Hollis, N.Y.

[21] Appl. No.: 216,589

[22] Filed: Dec. 15, 1980

[51] Int. Cl.[3] ..... A63H 3/20; A63F 9/00; A63H 13/02

[52] U.S. Cl. ..... 46/120; 46/123; 46/141; 46/149; 273/1 GF

[58] Field of Search ..... 273/1 GF, 1 GG, 1 GC, 273/1 GD; 46/120, 123, 141, 149

[56] References Cited

U.S. PATENT DOCUMENTS

| | | | |
|---|---|---|---|
| 1,649,072 | 11/1927 | McAllaster | 46/123 |
| 2,329,564 | 9/1943 | Thomas | 46/123 |
| 2,594,448 | 4/1952 | Kieselhorst | 46/123 X |
| 3,630,520 | 12/1971 | Cooper | 273/1 R |
| 3,994,492 | 11/1976 | Breslow | 273/1 GG |
| 4,050,183 | 9/1977 | Watanabe | 46/141 X |
| 4,218,844 | 8/1980 | Knibbs | 46/149 |

*Primary Examiner*—Paul E. Shapiro

*Attorney, Agent, or Firm*—Richard M. Rabkin

[57] ABSTRACT

A toy game comprises a simulated alligator body having a pair of jaws mounted thereon for movement between relatively closed and opened positions. At least one of the alligator's legs is pivotally mounted on the body for movement between an extended position wherein the leg engages the support surface for the toy and a second, retracted position. A latch arrangement is provided in the body operatively engaged with the leg for releasably latching the upper jaw in its opened position upon movement of the leg from its retracted to its extended position. A plurality of game objects are placed in the lower jaw to cause it to move away from the upper jaw toward its open position. The lower jaw is operatively engaged with the latch to release it upon movement of the lower jaw past a predetermined position so that the jaws return together to their closed position and the leg moves to its retracted position whereby the toy simulates a snapping action in the animal.

11 Claims, 8 Drawing Figures

BALANCE OPERATED GAME

The present invention relates to a game and, in particular, to a game using a toy device simulating the actions of an animal.

Previously proposed games such as that shown, for example, in U.S. Pat. No. 3,994,492 utilize game devices having the form of a simulated animal, wherein the animal's mouth will close upon removal of objects from the mouth, to signify the end of the game. As only one of the simulated animal's jaws moves, the game lacks a certain realism in play.

It is an object of the present invention to provide an improved game apparatus simulating the actions of an animal.

Another object of the present invention is to provide a game apparatus which will simulate the snapping action of an animal when an object is placed in its mouth.

A further object of the present invention is to provide a toy vehicle game which is durable in use and economical to manufacture.

In accordance with an aspect of the present invention a game device is provided which is in the shape of a simulated animal such as, for example, an alligator. The device is formed of a molded plastic construction and includes upper and lower jaws pivotally mounted on the animal's body for movement between respectively relatively opened and closed positions. A pair of simulated legs having feet are pivotally mounted on the body for movement between a retracted position wherein the feet are adjacent the body and an extended position wherein the feet are engaged with the surface on which the body is placed thereby to hold the jaws of the device above the support surface. These legs are biased to their retracted position and latch means, responsive to pivotal movement of the legs from their retracted to their extended position, serves to pivot the upper jaw from its closed to its open position, hold it in its upper position, and latch the legs in their extended position. Spring means normally biases the lower jaw to its closed position so that when the jaw is open, the simulated toy animal's mouth is only partially opened.

A plurality of game pieces in a variety of configurations are provided to be placed in the lower jaw of the animal of response to instructions determined by chance means operated by the players. The placement of these game pieces in the lower jaw moves it towards its opened position against the bias of the spring means. The lower jaw is operatively engaged with the latch for releasing the latch when the lower jaw reaches its fully opened position whereby the animal's legs are returned to their retracted position to propel the body forward while the jaws both return to their closed position in a simulated snapping action.

The above, and other objects, features and advantages of this invention will be apparent in the following detailed description of an illustrative embodiment thereof, which is to be read in connection with the accompanying drawings, wherein.

Figure 1:
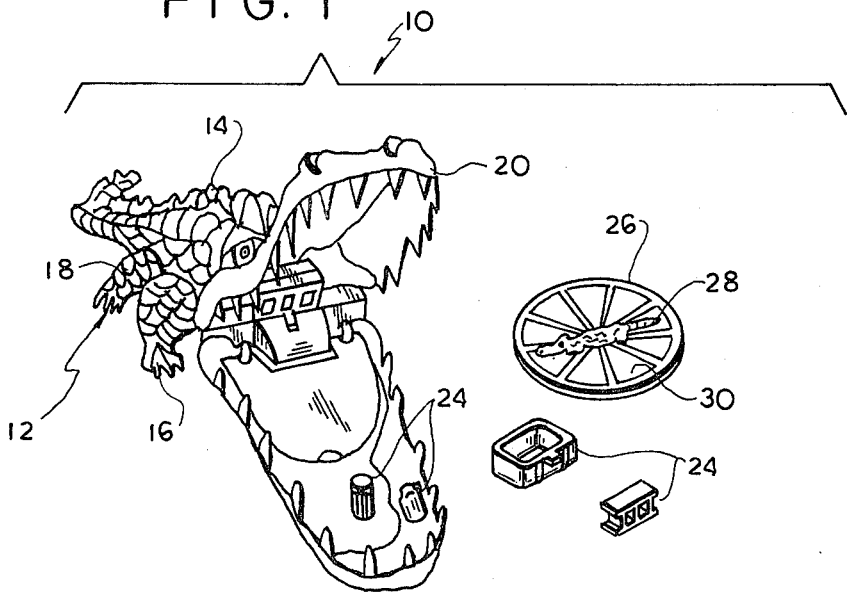
FIG. 1 is a perspective view of a game apparatus constructed in accordance with the present invention.

Referring now to the drawings in detail, and initially to FIGS. 1–4 thereof, a game apparatus 10 constructed in accordance with the present invention includes a simulated animal 12, such as, for example, an alligator, having a body 14, front and rear legs 16, 18, and a pair of jaws 20, 22. The jaws of the animal are movable between open and closed positions and the game is constructed such that the toy will simulate a snapping action by closing its jaws and lunging forward when a sufficient number of articles are placed in its lower jaw 22.

More specifically, the game apparatus includes a plurality of sets of game pieces 24 which may consist of assorted simulated pieces of junk, such as tin cans, garbage bags, old tires and the like. These game pieces are selectively placed in or removed from the lower jaw 22 of the game device in accordance with instructions determined by the chance means 26. The latter consists of a spinner having a pointer in the shape of a simulated alligator 28 pivotally mounted thereon and a plurality of written instructions printed in the individual segments 30 of the spinner. The players sequentially operate the spinner and follow the instructions determined by the spinner to place in or remove from jaw 22 articles of junk 24. When a number of articles of sufficient weight are placed in jaw 22 the jaws of the animal will snap closed and lunge forward and the whole game device 12 will lunge forward.

Figure 2:
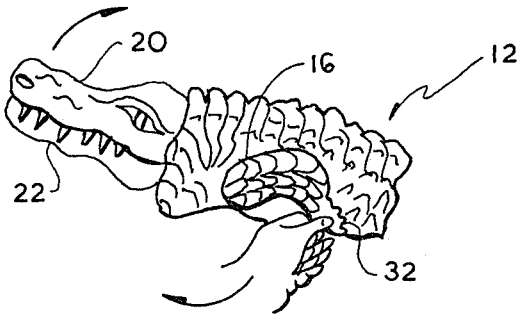
FIGS. 2–4 are a sequence of perspective views showing the operation of the game device.
Figure 3:
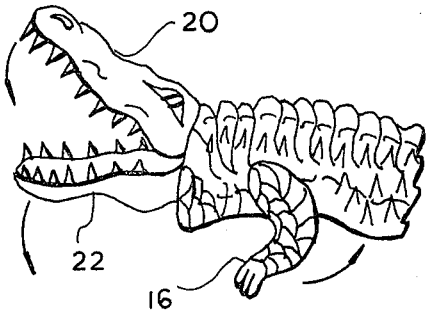
Figure 4:
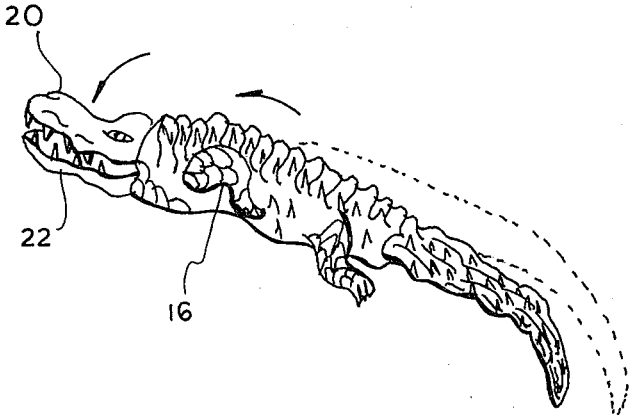

Game device 12 is activated, as illustrated in FIG. 2, by rotating the forward legs 16 thereof from the retracted position shown in FIG. 2 in a clockwise direction to an extended position shown in FIG. 3. In the extended position the feet 32 of the legs 16 engage the surface upon which the toy is supported and hold jaws 20, 22 above that surface. Pivotal movement of legs 16 also pivots upper jaw 20 from its closed to its opened position. As game objects are placed in lower jaw 22, that jaw pivots downwardly until a predetermined position at which it reaches its fully opened position. Placement of further weight in the jaw beyond that point will cause the jaws to snap closed, as illustrated in FIG. 4. At the same time, legs 16 return to their retracted position, causing the game device to lunge forwardly while the jaws snap.

Figure 8:
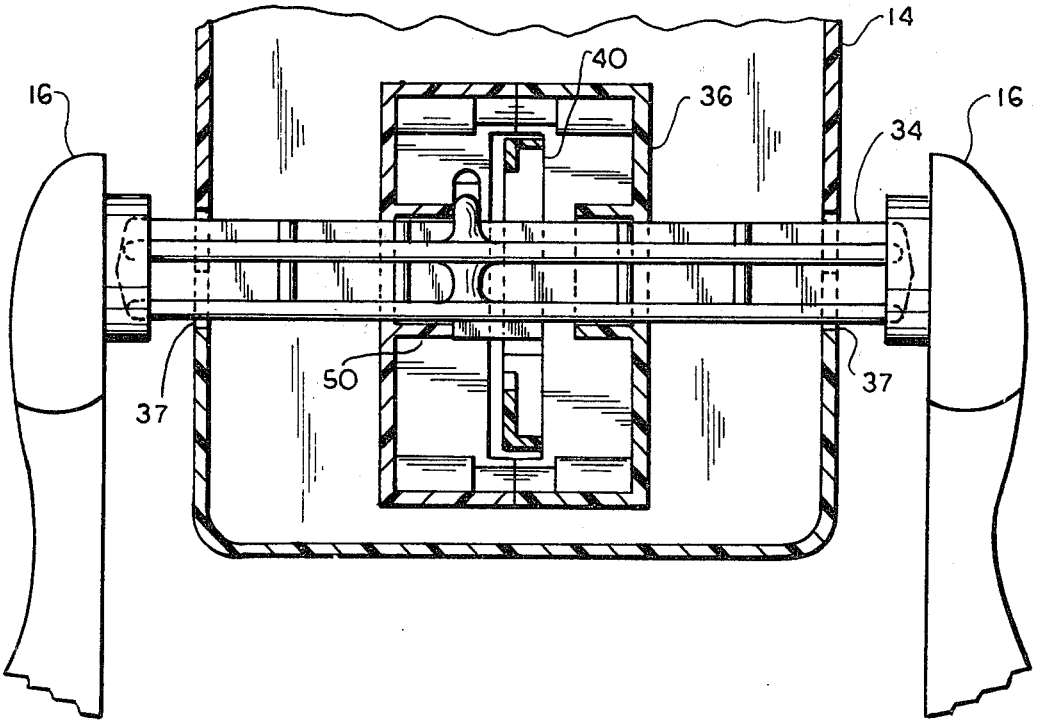
FIG. 8 is a sectional view taken along line 8—8 of FIG. 5.
Figure 5:
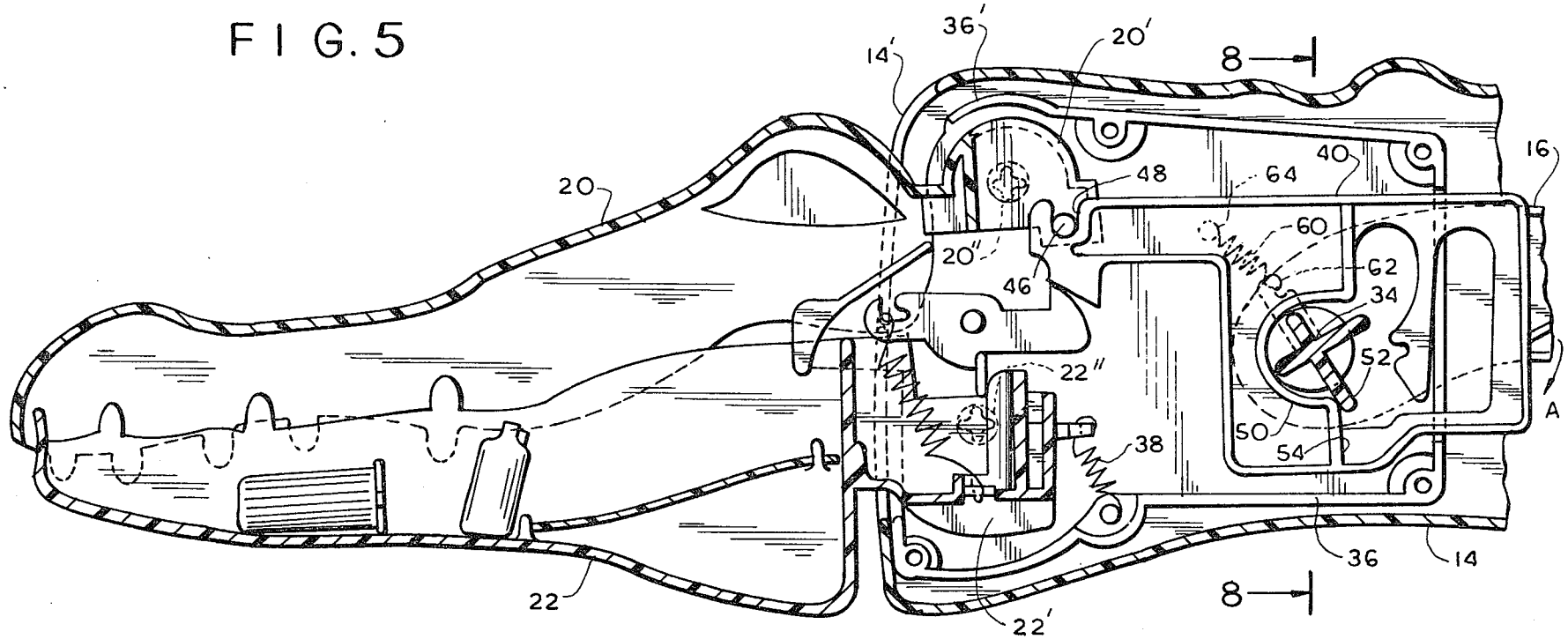
FIG. 5 is an enlarged sectional view of the head and forward body portion of the game apparatus of the present invention with the jaws in their closed position.

The mechanism for permitting the game device to function in the manner described is illustrated in greater detail in FIGS. 5 and 8. As seen in FIG. 8, legs 16 are secured to a shaft 34 which is pivotally mounted in openings 36 formed in the sides of body 14. The shaft extends through a mechanism housing 36 secured in body 14 in any convenient manner. Mechanism housing 36 is formed of two molded plastic elements screwed together to form an enclosure for the operating mechanism of the device. The jaws 20, 22 have inner ends 20', 22', respectively, which include integral pivot pins 20'', 22'', on opposite sides thereof (only one of which is seen in FIG. 5) that are pivotally received in bosses formed on the interior sides of housing 36, thereby to pivotally mount the jaws in the housing. As can be seen in FIG. 5, the jaws extend out of the open ends 36', 14' in housing 36 and body 14. A spring 38 is secured between the inner end 22' of jaw 22 and housing 36 to normally bias jaw 22 into its closed position.

The inner end 20' of jaw 20 is also pivotally connected to a push plate 40 which is slidably mounted in housing 36. In particular, plate 40 includes a rear extension 42 which passes through a complementary opening 44 in the rear of housing 36 to permit push plate 40 to slide inwardly toward and outwardly away from jaws 20, 22. The pivotal connection between jaw 20 and push plate 40 is formed by a pin 46 integrally formed at the rear end of jaw 20 which is received in a slot 48 formed in the forward end of push plate 40.

Push plate 40 includes a semi-circular recess 50 formed therein through which shaft 34 of legs 16 passes. This shaft is generally cruciform in cross-section, with one of the legs thereof being materially longer than the remaining legs. This leg 52 is located to engage the surface 54 adjacent recess 50. By this construction, when leg 16 is pivoted in a clockwise direction as indicated by arrow A in FIG. 5, leg 52 will push plate 40 forwardly in housing 36. This forward movement of the push plate will cause jaw 20 to move from its closed position shown in FIG. 5 to its opened position shown in FIG. 6.

Shaft 34 is biased to rotate in a counterclockwise direction by a spring 60 connected between an extension 62 on shaft 34 and a post 64 on push plate 40. This spring thus also tends to draw push plate 40 towards the right in FIG. 5 and biases jaw 20 towards its closed position.

In order to hold legs 16 in their extended position and jaw 20 in its opened position, a latching arrangement iis provided. One portion of this latching arrangement includes a spring finger 66 integrally formed with push plate 40 and having a notch 68 formed therein facing shaft 34. One of the legs 70 of shaft 34 includes an extension 72 which enters recess or notch 68 when the shaft 34 has been rotated through about 45° to move jaw 20 to its opened position. This latches the shaft 34 against rotary movement under the influence of spring 60.

Figure 6:
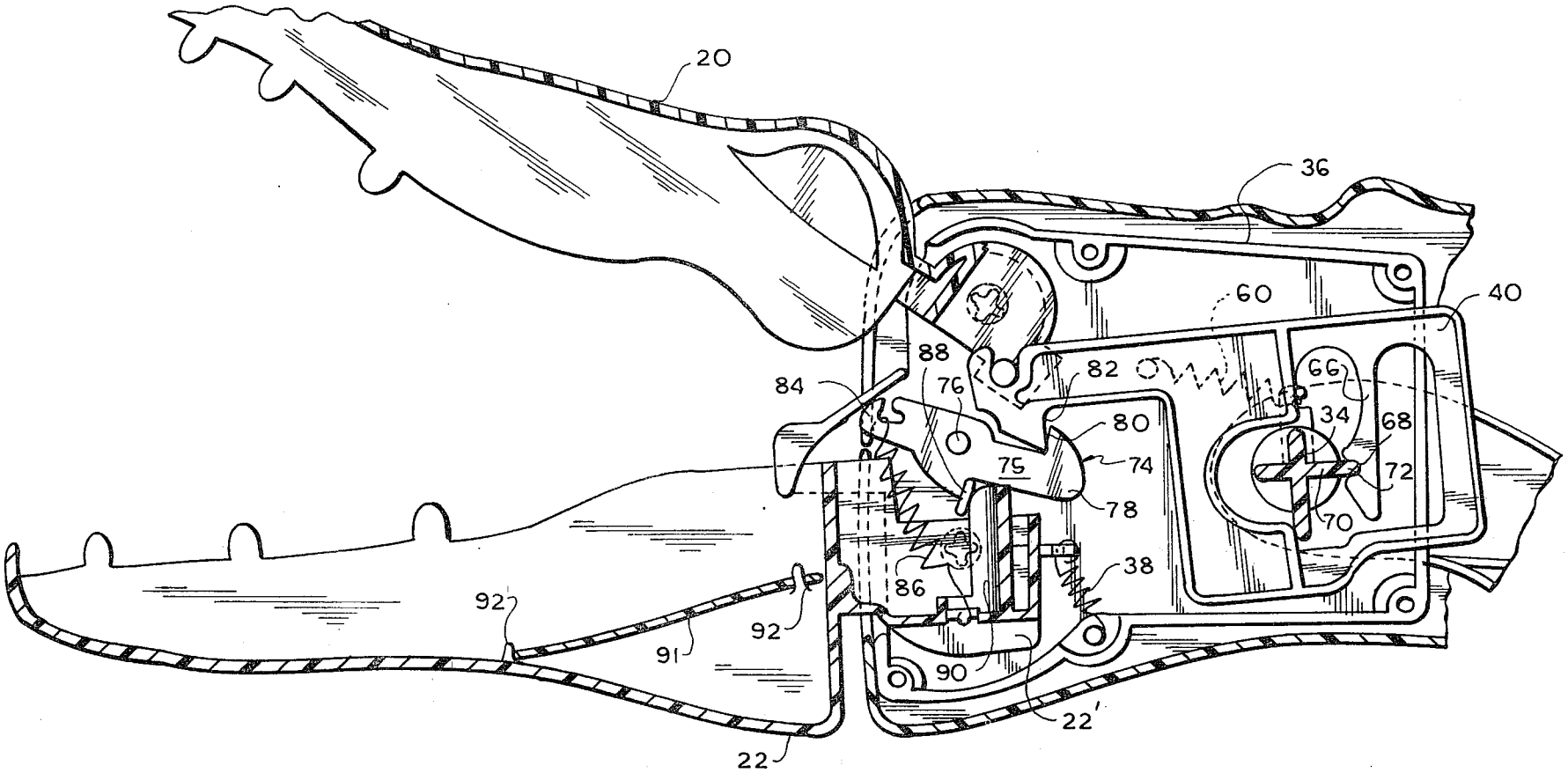
FIG. 6 is a sectional view similar to FIG. 5 after the legs of the game have been moved to their extended position and showing the upper jaw latched in its opened position.

At the same time a separate latch member 74 engages the push plate 40 to hold it in its forward position, illustrated in FIG. 6, also against the bias of the spring 60. This latch element consists of a lever 75 which is pivotally mounted on a pivot pin 76 or the like within housing 36. One end 78 of lever 75 includes a tooth 80 located to engage the tooth 82 formed on the forward end of push plate 40. The opposite end 84 of lever 75 is engaged with a spring 86 connected to the rear end 22' of jaw 22.

As seen in FIGS. 5 and 6, when push plate 40 is moved forwardly as a result of pivotal movement of shaft 34, the plate's tooth 84 passes over and engages the tooth 80 of lever 75. The lever includes an extension 88 that is engaged with an upstanding boss 90 on the rear end 22' of jaw 22. This engagement of extension 88 with boss 90 prevents latch 75 from rotating in a counterclockwise direction under the influence of spring 86, with the result that the latch holds the push element 40 in the position shown in FIG. 6, thereby holding jaw 20 in its opened position when legs 16 are pivoted to their extended position. In this position, play of the game can commence.

As described above, in the course of the play of the game, the players utilize the chance means or spinner 26 to determine whether they should place or remove articles of junk from the jaws of the alligator. Placement of these game pieces in the mouth of the alligator causes jaw 22 to pivot downwardly towards its opened position against the bias of spring 38. If desired, a carboard tongue-like element 90 may be mounted within jaw 22 on pins 92 or the like, to give a more realistic appearance to the game. Part of the rules of the game may be that articles of junk may not be placed on tongue 90, but must only be placed in the forward portion of jaw 22. This will enhance the moment affect produced by the weight of the game pieces in the jaw to overcome the force of the spring 38.

Figure 7:
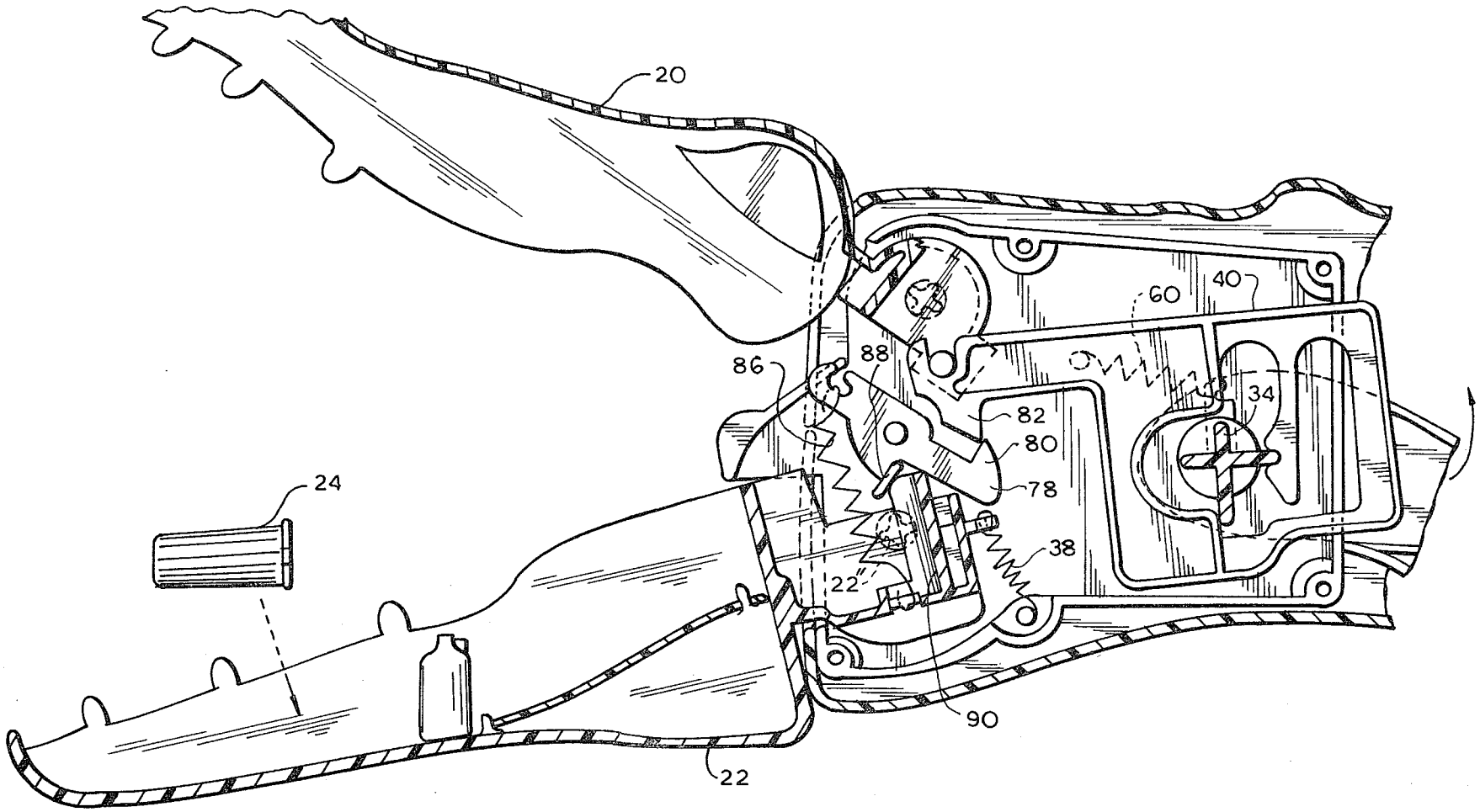
FIG. 7 is a cross-sectional view similar to FIG. 6, but showing the lower jaw having been pivoted to its extreme lower position as a result of the weight of game objects placed in the jaw, and just prior to release for snapping.

When game pieces 24 of a sufficient weight are placed in jaw 22, the jaw will have pivoted to its fully opened position, illustrated in FIG. 7. This pivotal movement of the jaw 22 causes boss 90 to push forwardly against the extension 88 of lever 75, causing it to pivot in a clockwise direction, against the bias of spring 86. When any further game pieces are placed in jaw 22, further pivotal movement of the jaw will cause the teeth 80, 82 on latch 75 and push plate 40 to disengage. This disengagement permits the spring 60 to become effective on shaft 34 and push plate 40. Thus, the spring will simultaneously urge push plate 40 to the right in FIG. 7 while causing shaft 34 to rotate in a counterclockwise direction. This movement of the push plate and shaft will cause upper jaw 20 to return toward its closed position and legs 16 to rotate in a counterclockwise direction towards their retracted position. Movement of the legs in this manner causes the body of the game device to move forwardly in a lunging action.

As jaw 20 closes, jaw 22 will also move from its opened position back to its closed position under the influence of spring 38. Because spring 86 is connected to the jaw 22 at a location directly below the pivot pin 22" for the jaw it will have little or no effect on the pivotal motion of jaw 22.

Accordingly, by the described structure, the jaws 20 and 22 will simultaneously snap shut under the influence of springs 60 and 38 while the body of the game device lunges forwardly in a "terrifying" snapping action.

Although an illustrative embodiment of the invention has been described herein with reference to the accompanying drawings, it is to be understood that the invention is not limited to that precise embodiment, but that various other changes and modifications may be effected therein by one skilled in the art without departing from the scope or spirit of this invention.

What is claimed is:

1. A game device comprising a simulated body including a pair of simulated animal jaws mounted thereon for movement between relatively closed and opened positions; an actuating lever pivotally mounted on said body for movement between first and second positions, latch means in said body operatively engaged with said lever for releasably latching one of said jaws in its opened position upon movement of said lever from its first to its second position; a plurality of game objects adapted to be placed in the other of said jaws to cause said other jaw to move away from said first jaw to its opened position; said second jaw being operatively engaged with said latch means to release said latch means upon movement of said other jaw past a predetermined position whereby said jaws return together to their closed positions.

2. A game device as defined in claim 1 wherein said lever extends beyond the body in position to engage a support surface on which the game device is placed when the lever is in its second position, and means for returning said lever from its second to its first position upon release of said latch means whereby said lever propels said body forwardly when said jaws close to simulate the snapping action of an animal.

3. A game device defined in claim 2 wherein said lever is a simulated leg.

4. A game device as defined in claim 3 wherein said simulated body, jaws, and leg are those of an alligator.

5. A game device as defined in claim 1 wherein said jaws are pivotally mounted on said body and spring means normally biases said second jaw towards its closed position.

6. A game device as defined in claim 5 wherein said lever includes a pivot shaft pivotally mounted in said body and said latch means includes means responsive to pivotal movement of said shaft and engaged with said first jaw to pivot said first jaw to its opened position.

7. A game device as defined in claim 6 wherein said latch means includes a spring biased latch element pivotally mounted in said body for latching said means responsive to pivotal movement of the shaft in position to hold said first jaw opened.

8. A game device as defined in claim 7 wherein said latch element and second jaw include operably engaged portions respectively located such that pivotal movement of said second jaw towards its second position as game objects are placed therein causes pivotal movement of said latch element to unlatch said means responsive to pivotal movement of the shaft and permit said jaws to return to their relatively closed positions.

9. A game device comprising a body in the shape of a simulated animal, simulated upper and lower jaws pivotally mounted on said body for movement between respectively relatively opened and closed positions; a pair of simulated legs having feet and being pivotally mounted in said body for pivotal movement between a first retracted position wherein the feet are adjacent the body and a second extended position wherein the feet may engage a support surface on which the body is placed to hold said jaws above said support surface; spring means for biasing said legs to said retracted position; latch means responsive to pivotally movement of said legs from said retracted to said extended position for pivoting said upper jaw from its closed to its open position and holding it in said open position while latching said legs in said extended position; means normally biasing said lower jaw to its closed position; a plurality of game pieces adapted to be placed in said lower jaw to move said lower jaw towards its open position against the bias of said biasing means; said lower jaw being operatively engaged with said latching means for releasing the latching means when the lower jaw reaches its opened position whereby said legs are returned to their retracted position by said spring means to propel said body forward while said jaws return to their closed positions in a simulated snapping action.

10. A game device as defined in claim 9 wherein said legs include a common pivot shaft and said latch means comprises a pusher element movably mounted in said body transversely of said shaft; said pusher element being engaged with said upper jaw to pivot the upper jaw toward its opened position when the pusher element is moved forwardly in said body towards said jaws; said shaft having a lever extension thereon engaged with said pusher element to push said pusher element forwardly upon rotation of said legs from said retracted position to said extended position.

11. A game device as defined in claim 10 wherein said latch means includes a latch element pivotally mounted in said body, said pusher element and said latch element having cooperating surfaces adapted to latch said pusher element in its upper jaw opened position and second spring means connected between said latch element and said lower jaw to bias said latch element into latching engagement with said pusher element.

* * * * *